US009013108B1

(12) United States Patent
Tu et al.

(10) Patent No.: US 9,013,108 B1
(45) Date of Patent: Apr. 21, 2015

(54) LED ELEMENT WITH COLOR LIGHT ENHANCEMENT FUNCTION

(71) Applicant: Anwell Semiconductor Corp., Hsin-Chu (TW)

(72) Inventors: Shih-Ping Tu, Hsin-Chu (TW); Ke-Horng Chen, Hsin-Chu (TW); Chun-Chieh Kuo, Hsin-Chu (TW); Shao-Wei Chiu, Hsin-Chu (TW); Cheng-Po Hsiao, Hsin-Chu (TW)

(73) Assignee: Anwell Semiconductor Corp., Hsin-Chu (TW)

( * ) Notice: Subject to any disclaimer, the term of this patent is extended or adjusted under 35 U.S.C. 154(b) by 0 days.

(21) Appl. No.: 14/103,125

(22) Filed: Dec. 11, 2013

(51) Int. Cl.
*H05B 37/00* (2006.01)
*H05B 33/08* (2006.01)

(52) U.S. Cl.
CPC ..... *H05B 33/0848* (2013.01); *H05B 33/0824* (2013.01)

(58) Field of Classification Search
CPC ..... F21Y 2113/005; H05B 33/083; H05B 33/0857; H05B 33/0803; H05B 37/02; H05B 33/0824; C09K 11/586
USPC ..... 315/121, 122, 185 R, 186, 192, 246, 315/294; 362/230, 231, 249.2, 800
See application file for complete search history.

(56) References Cited

U.S. PATENT DOCUMENTS

| | | | | |
|---|---|---|---|---|
| 6,577,073 | B2 * | 6/2003 | Shimizu et al. | 315/246 |
| 7,005,679 | B2 * | 2/2006 | Tarsa et al. | 257/89 |
| 8,193,721 | B2 * | 6/2012 | Cho et al. | 315/251 |
| 8,193,735 | B2 * | 6/2012 | Wei et al. | 315/294 |
| 8,272,757 | B1 * | 9/2012 | Fan et al. | 362/231 |
| 8,648,546 | B2 * | 2/2014 | Van De Ven et al. | 315/294 |
| 8,779,685 | B2 * | 7/2014 | Wang et al. | 315/294 |
| 8,884,508 | B2 * | 11/2014 | Pickard et al. | 313/501 |
| 8,901,845 | B2 * | 12/2014 | Pickard et al. | 315/291 |

FOREIGN PATENT DOCUMENTS

TW 201230867 7/2012

* cited by examiner

*Primary Examiner* — Vibol Tan
(74) *Attorney, Agent, or Firm* — Rosenberg, Klein & Lee

(57) ABSTRACT

An LED element with a color light enhancement function is a two-terminal element for receiving a driving current to emit light and includes at least one blue LED chip, at least one red LED chip and a three-way compensator. The three-way compensator intercepts a driving current passing through the blue LED chip depending on a proportion value according to a change of working temperature and adjusts the amount of current flowing into the red LED chip. If the working temperature exceeds a default value, an input terminal of the three-way compensator is triggered to intercept the driving current and generate and output a set current to the red LED chip to compensate an attenuation of the red LED chip caused by high temperature. The LED element will not be changed its intensity after a prolonged period of usage.

5 Claims, 3 Drawing Sheets

LED ELEMENT WITH COLOR LIGHT ENHANCEMENT FUNCTION

BACKGROUND OF THE INVENTION

1. Field of the Invention

The present invention relates to the technical field of light emitting elements, and more particularly to a light emitting diode (LED) element with a color light enhancement function, and the LED element uses the method of adjusting the actual amount of current received by each light emitting chip in the LED element by a three-way compensator to compensate the light attenuation of the light emitting chip caused by a rise of temperature.

2. Description of the Related Art

As LED with its features of low power consumption and high performance hits the illumination market, it is a main subject for related manufacturers to find a way of controlling the illumination brightness, working efficiency or using life of an LED lamp In the current market, most light source elements used in the LED lamps include at least one blue LED chip and at least one red LED chip in a single package, and these two light emitting chips with different color temperatures are installed to produce an illumination color in compliance with user requirements or the light source element is even mixed with a yellow or red phosphor, and the optical effect of the phosphor is used to adjust the color temperature of the light source such as a warm yellow light source emitted by the light source element. However, the light source element adopting the aforementioned blue and red LED chips may have the problems of shifting color temperature of a light emitted by the light source element after a long time of operation and affecting the illumination quality of the LED lamps. This is due to the red LED chip has a more significant light attenuation than that of the blue LED chip in a high temperature environment.

To overcome the aforementioned problem, R.O.C. Pat. Publication No. 201230867 discloses an illumination device and an LED device thereof, wherein an impedance providing element with a positive temperature coefficient is connected to at least one red light LED in parallel. In the concept of the Ohm's law, the greater impedance value of a parallel circuit, the smaller the amount of current, so that the actual amount of current received by of the red light LED can increase with the working time, and the serious light attenuation of the red light LED occurred at high temperature can be compensated to achieve the effect of stabilizing the illumination performance of the LED lamp. This patent simply utilizes impedance to provide the effect of consuming more power at the beginning of an operation only, but the concept of the invention of receiving the driving current outputted from a driver by the red light LED directly after a long time of operation to achieve the effect of compensating the light attenuation. As to the physical properties of the blue light LED and the red light LED, a high-temperature working environment will result in a more serious light attenuation of the red light LED than the blue light LED. Even though the red light LED can receive the driving current completely, the intensity of the driving current received by the blue light LED is the same, so that the difference of the light emitting efficiency between the red and blue light LEDs will affect the color temperature of the illumination of the LED lamp.

In addition, the common conventional LED lamp includes a plurality of LEDs arranged into an illumination light source, and the LEDs are generally connected in series with one another, and the foregoing patented invention is of no exception. Therefore, when one of the LEDs is damaged to form an open circuit status, the remaining LEDs coupled to the same circuit will stop their operation and cannot emit light, and thus seriously affecting the illumination effect of the LED lamp, and resulting in a longer inspection time for operators or maintenance technician to find the damaged LEDs.

Therefore, it is a main subject of the present invention to combine the blue LED chip and the red LED chip to produce a single-package LED, while using an integrated circuit with the circuit compensation function and the open circuit protection function installed in the components to provide the function of automatically adjusting the intensity of the current passing into the red LED chip, so as to prevent the light attenuation caused by a temperature rise after a long time of operation of the red LED chip.

SUMMARY OF THE INVENTION

In view of the aforementioned drawbacks of the prior art, it is a primary objective of the present invention to overcome the drawbacks by providing an LED element with a color light enhancement function, comprising a blue LED chip, a red LED chip and an integrated circuit with a circuit compensation function packaged therein, and the integrated circuit is provided for sensing a component temperature and then adjusting the intensity of current actually passing through the red LED chip to achieve the current compensation effect and assure a constant light emitting efficiency of the LED element.

To achieve the aforementioned objective, the present invention provides an LED element with a color light enhancement function being a two-terminal element having an anode and a cathode and provided for emitting light after receiving a driving current, and automatically compensating an internal working current to prevent an emitted color light from being affected by the length of working time. The LED element comprises: at least one blue LED chip, at least one red LED chip and a three-way compensator. An input terminal of the three-way compensator is coupled to an anode of the blue LED chip to form an anode of the LED element. In other words, the anode of the blue LED chip receives the driving current. A compensation terminal of the three-way compensator is coupled to a serial connection position between the blue LED chip and the red LED chip, and an output terminal of the three-way compensator is coupled to a cathode of the red LED chip to form a cathode of the LED. In addition, the three-way compensator intercepts the driving current passing through the blue LED chip based on a proportion value through the compensation terminal according to a change of the working temperature of the LED element to adjust the amount of current of the red LED chip, and the proportion value decreases with an increase of the working temperature, and if the working temperature exceeds a default value, an input terminal of the three-way compensator will be triggered to intercept the driving current to generate a set current and then transmit the set current to the red LED chip through the compensation terminal to compensate an attenuation of the red LED chip caused by high temperature and maintain the intensity of light emitted by the LED element constant.

For the practical application of the single-packaged LEDs in a lamp, a series circuit is adopted. If any one of the blue LED chip and the red LED chip is damaged to form an open circuit status, the three-way compensator will be conducted to receive the driving current completely.

Wherein, if the proportion value decreases with an increase of the working temperature to the level of the driving current received by the red LED chip completely, and the attenuation of the light emitting efficiency of the red LED chip is still greater than that of the blue LED chip, the input terminal of the three-way compensator will be triggered and operated. The default value is 60~100° C., and the three-way compensator is a semiconductor part or a temperature coefficient part.

In summation of the description above, the present invention is an integrally packaged light emitting element and the three-way compensator is used to slightly reduce the amount of driving current passing into the red LED chip by the proportion value at an early working stage of the element and a lower temperature condition, and intercept the driving current before passing into the blue LED chip through an input terminal of the element at the stage of a longer working time and a higher temperature condition, so as to form an additional compensation current passing into the red LED chip. As a result, the actual amount of current loaded in the red LED chip can vary automatically with the temperature to compensate the brightness attenuation of the conventional light emitting element and achieve the effects of constant light emitting efficiency.

DETAILED DESCRIPTION OF THE PREFERRED EMBODIMENTS

The aforementioned and other objectives, technical characteristics and advantages of the present invention will become apparent with the detailed description of preferred embodiments and the illustration of related drawings as follows.

Figure 1:
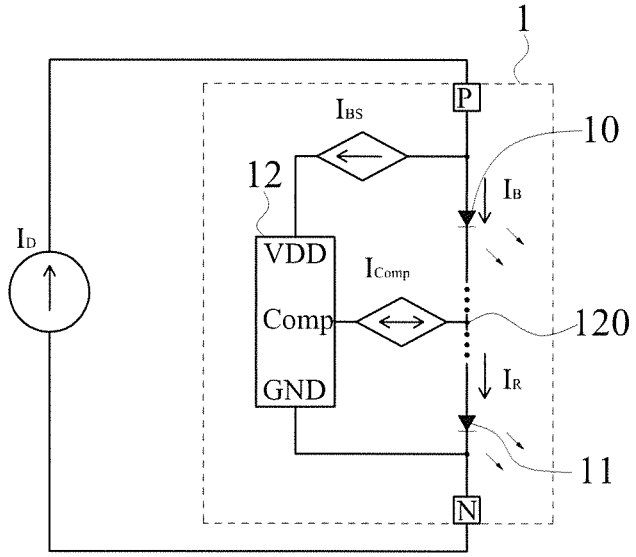
FIG. 1 is a schematic circuit diagram of a preferred embodiment of the present invention.
Figure 2:
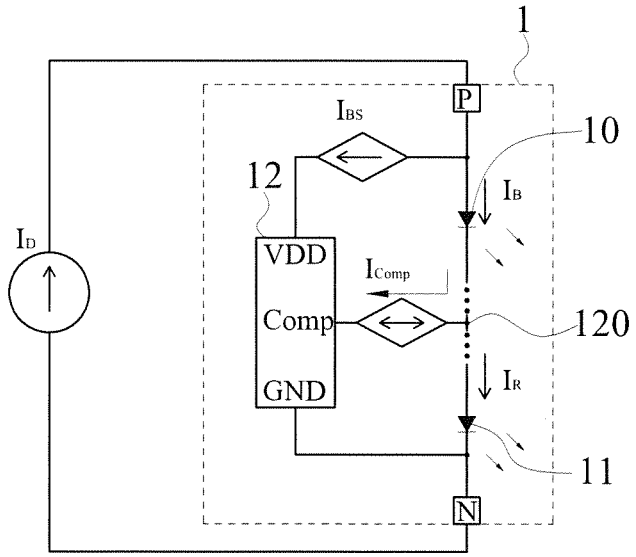
FIG. 2 is a schematic view of a first embodiment of the present invention.

With reference to FIG. 1 for the schematic circuit diagram of an LED with an enhanced color light function in accordance with a preferred embodiment of the present invention, the LED element 1 is a two-terminal element with an anode and a cathode for receiving a driving current ($I_D$) and then emitting light, and the LED element 1 comprises at least one blue LED chip 10, at least one red LED chip 11 and a three-way compensator 12. The three-way compensator 12 has an input terminal (VDD) coupled to an anode of the blue LED chip 10 to form an anode (P) of the LED element 1. An output terminal (GND) of the three-way compensator 12 is coupled to a cathode of the red LED chip 11 to form a cathode (N) of the LED element 1, and an anode of the red LED chip 11 is coupled in series to a cathode of the blue LED chip 10 to form a compensation node 120. A compensation terminal (Comp) of the three-way compensator 12 is coupled to a serial connection position (which is the compensation node 120) between the blue LED chip 10 and the red LED chip 11. The three-way compensator 12 is a semiconductor part or a temperature coefficient part. Therefore, the driving current ($I_B$) passing through the blue LED chip 10 can be intercepted by the compensation terminal according to a change of working temperature of the LED element 1 based on a proportion value. In FIG. 2, the three-way compensator 12 obtains a compensation current ($I_{Comp}$) from the compensation terminal to adjust the flow of current ($I_R$) of the red LED chip 11.

Figure 3:
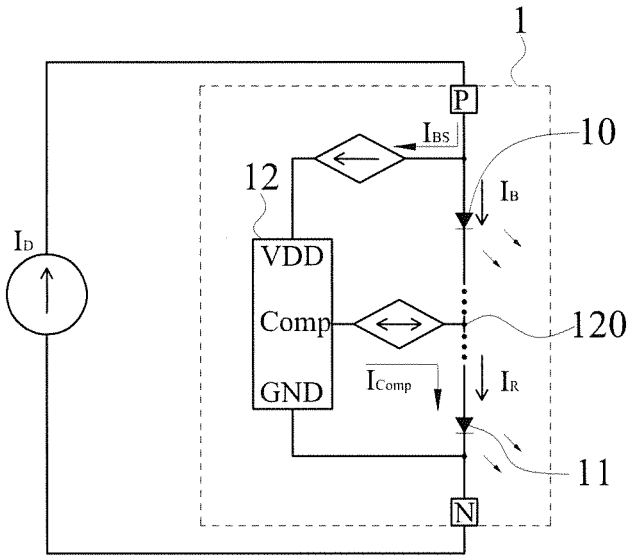
FIG. 3 is a schematic view of a second embodiment of the present invention.

The proportion value decreases with an increase of the working temperature. When the working temperature reaches a default value, the compensation current no longer flows into the three-way compensator 12, so that the red LED chip 11 receives the driving current completely. When the working temperature exceeds the default value, such as 60° C., 62° C., 65° C., 68° C., 70° C., 73° C., 75° C., 77° C., 80° C., 82° C., 85° C., 88° C., 90° C., 93° C., 95° C., 97° C. or 100° C., and the attenuated light emitting efficiency of the red LED chip 11 is still greater than that of the blue LED chip 10, the input terminal of the three-way compensator 12 is trigger to intercept the driving current and then form a set current ($I_{Bs}$) as shown in FIG. 3. Then the three-way compensator 12 uses the set current as the compensation current and outputs the compensation current to the red LED chip 11 through the compensation terminal to increase the actual amount of current received by the red LED chip 11. Which means, the three-way compensator 12 compensates the attenuation of the red LED chip 11 caused by high temperature, so as to maintain the light intensity emitted by the LED element 1 constant. In other words, the LED element 1 can achieve the effect of compensating the internal working current automatically, so that the color light emitted by the LED element 1 is not affected by the length of the working time.

Actual measurements taken by using 64° C. as the default value of the LED element 1 are listed in Table 1 as follows. When the working temperature changes from 27° C. to 60° C., the three-way compensator 12 gradually decreases the $I_{Comp}$ intercepted by the compensation terminal, and when the working temperature reaches 70° C., the three-way compensator 12 uses $I_{Bs}$ to form the compensation current for increasing the amount of current $I_R$. Therefore, the attenuation of the light emitting efficiency of the red LED chip 11 caused by a long time of operation and a high temperature can be overcome by an increase of $I_R$, so that the power of the red LED chip 11 can be maintained constant to assure the stability of light intensity and color temperature.

TABLE 1

| Temperature (° C.) | Light Emitting Brightness of Red LED Chip (%) | Light Emitting Brightness of Blue LED Chip (%) | $I_R$ (mA) | $I_{Comp}$ (mA) |
|---|---|---|---|---|
| 27 | 100 | 100 | 85 | −35 |
| 40 | 96 | 99 | 96 | −32.45 |
| 50 | 89 | 97 | 108 | −29.9 |
| 60 | 82 | 94 | 120 | −27.35 |
| 70 | 77 | 91 | 132 | 24.8 |
| 80 | 72 | 89 | 144 | 22.25 |
| 90 | 67 | 86 | 156 | 19.7 |
| 100 | 62 | 83 | 168 | 17.15 |

Figure 4:
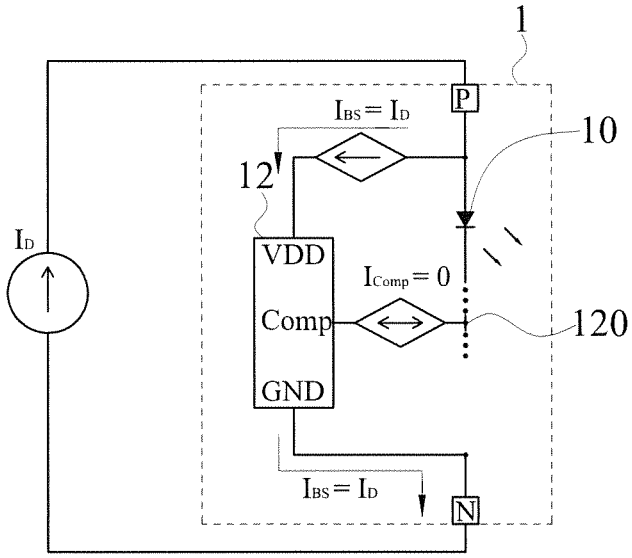
FIG. 4 is a schematic view of a third embodiment of the present invention.
Figure 5:
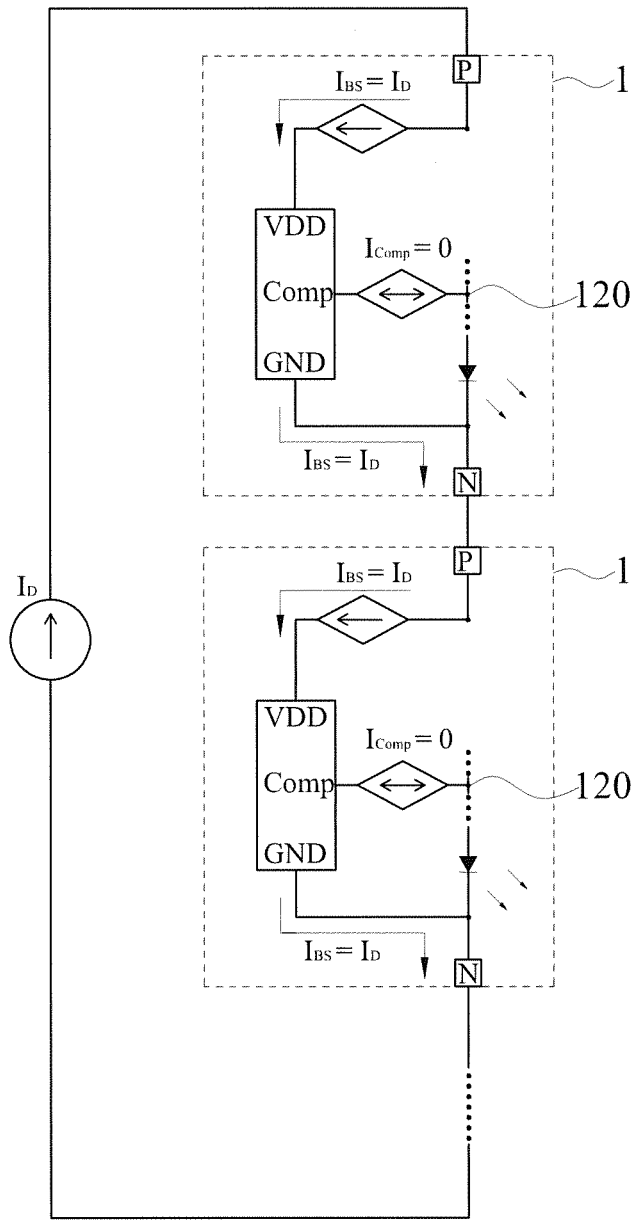
FIG. 5 is a schematic view of a fourth embodiment of the present invention.

In this preferred embodiment, both blue LED chip 10 and red LED chip 11 come with plural quantity, and the blue LED chips 10 are coupled in series to form a blue light string, and the red LED chips 11 are coupled in series to form a red light string, and the two strings are coupled in series with each other. When any one of the blue LED chips 10 and the red LED chips 11 is damaged to form an open circuit status, the three-way compensator 12 will be conducted to receive the driving current completely, so as to provide a protection effect. For instance, if the red LED chip 11 as shown in FIG. 4 is in an open circuit status, or the blue LED chip 10 as shown in FIG. 5 is in an open circuit status, the driving current will flow from the anode of the LED element 1 into the input terminal of the three-way compensator 12 and then will flow out from the output terminal of the three-way compensator 12. In other words, $I_{Bs}=I_D$ and $I_R=I_B=I_{Comp}=0$, and the three-way compensator 12 forms an additional circuit for passing the driving current. When the LEDs are applied in a lamp, the plurality of LEDs 1 coupled in series to the same circuit will not be affected by a damaged or open-circuited LED. The lamp can still receive the driving circuit and operate normally, and operators can replace any unlit LED, so as to improve the maintenance and repair efficiency effectively.

What is claimed is:

1. A light emitting diode (LED) element with color light enhancement function, being a two-terminal element having an anode and a cathode and provided for emitting light after receiving a driving current, and automatically compensating an internal working current to prevent an emitted color light from being affected by the length of working time, comprising:

at least one blue LED chip, with an anode for receiving the driving current;

at least one red LED chip, with an anode coupled to a cathode of the blue LED chip in series; and a three-way compensator, having an input terminal coupled to an anode of the blue LED chip to form an anode of the LED element, a compensation terminal being coupled to a position where the blue LED chip and the red LED chip are connected in series, and an output terminal coupled to a cathode of the red LED chip to form a cathode of the LED element; thereby, the three-way compensator intercepts the driving current passing through the blue LED chip based on a proportion value through the compensation terminal according to a change of the working temperature of the LED element to adjust the amount of current of the red LED chip, and the proportion value decreases with an increase of the working temperature, and if the working temperature exceeds a default value, the input terminal of the three-way compensator will be triggered to intercept the driving current to generate a set current and then transmit the set current to the red LED chip through the compensation terminal to compensate an attenuation of the red LED chip caused by high temperature and maintain the intensity of light emitted by the LED element constant.

2. The LED element with a color light enhancement function according to claim 1, wherein the three-way compensator will be conducted to receive the driving current completely if at least one of the blue LED chip and the red LED chip is damaged to result in an open circuit status.

3. The LED element with a color light enhancement function according to claim 2, wherein the input terminal of the three-way compensator is triggered to operate if the proportion value decreases with an increase of the working temperature to the level which the driving current is received by the red LED completely and the attenuation of the light emitting efficiency of the red LED chip is still greater than that of the blue LED chip.

4. The LED element with a color light enhancement function according to claim 3, wherein the default value is from 60° C. to 100° C.

5. The LED element with a color light enhancement function according to claim 4, wherein the three-way compensator is a semiconductor part or a temperature coefficient part.

* * * * *